US011590564B2

(12) United States Patent
Wöstmann et al.

(10) Patent No.: US 11,590,564 B2
(45) Date of Patent: Feb. 28, 2023

(54) CASTING CORE FOR CASTING MOULDS, AND METHOD FOR THE PRODUCTION THEREOF

(71) Applicant: Fraunhofer-Gesellschaft zur Förderung der angewandten Forschung e.V., Munich (DE)

(72) Inventors: Franz-Josef Wöstmann, Bremen (DE); Lukas Stumm, Bremen (DE); Christian Soltmann, Bremen (DE); Matthias Busse, Bremen (DE)

(73) Assignee: Fraunhofer-Gesellschaft zur Förderung der angewandten Forschung e. V., Munich (DE)

( * ) Notice: Subject to any disclaimer, the term of this patent is extended or adjusted under 35 U.S.C. 154(b) by 0 days.

(21) Appl. No.: 17/250,827

(22) PCT Filed: Sep. 19, 2019

(86) PCT No.: PCT/EP2019/075170

§ 371 (c)(1),
(2) Date: Mar. 5, 2021

(87) PCT Pub. No.: WO2020/058402

PCT Pub. Date: Mar. 26, 2020

(65) Prior Publication Data

US 2021/0213514 A1 Jul. 15, 2021

(30) Foreign Application Priority Data

Sep. 19, 2018 (DE) ..... 10 2018 215 957.2

(51) Int. Cl.

| | |
|---|---|
| ***B22C 9/10*** | (2006.01) |
| ***B22C 1/18*** | (2006.01) |
| ***B22C 1/20*** | (2006.01) |

(52) U.S. Cl.

CPC ..... *B22C 9/10* (2013.01); *B22C 1/181* (2013.01); *B22C 1/185* (2013.01); *B22C 1/186* (2013.01); *B22C 1/20* (2013.01)

(58) Field of Classification Search

CPC ..... B22C 1/18; B22C 1/181; B22C 1/185; B22C 1/186; B22C 1/20; B22C 9/10

USPC ..... 164/369, 520, 525, 528

See application file for complete search history.

(56) References Cited

FOREIGN PATENT DOCUMENTS

| | | | |
|---|---|---|---|
| CN | 101716650 | A | 6/2010 |
| CN | 101905289 | A | 12/2010 |
| CN | 104550756 | | 4/2015 |
| CN | 107052254 | A | 8/2017 |
| DE | 1758532 | A | 1/1971 |
| DE | 19918908 | A1 | 11/2000 |
| DE | 10327272 | A1 | 3/2005 |
| DE | 102014221237 | A1 | 4/2015 |
| DE | 102016119399 | A1 | 4/2017 |
| EP | 2937161 | A1 | 10/2015 |
| FR | 1584065 | A | 12/1969 |
| JP | 2013071169 | A | 4/2013 |

OTHER PUBLICATIONS

"German Application Serial No. 10 2018 215 957.2, Office Action dated Sep. 27, 2018", (Sep. 27, 2018), 6 pgs.

"International Application Serial No. PCT/EP2019/075170, International Search Report dated Nov. 27, 2019", (Nov. 27, 2019), 2 pgs.

"International Application Serial No. PCT/EP2019/075170, Written Opinion dated Nov. 27, 2019", (Nov. 27, 2019), 6 pgs.

"Chinese Application Serial No. 201980061447.0, Office Action dated Apr. 15, 2022", w/English Translation, (Apr. 15, 2022), 21 pgs.

"Chinese Application Serial No. 201980061447.0, Office Action dated Oct. 24, 2022", w English Translation, (Oct. 24, 2022), 29 pgs.

*Primary Examiner* — Kevin P Kerns

(74) *Attorney, Agent, or Firm* — Schwegman Lundberg & Woessner, P.A.

(57) ABSTRACT

Disclosed herein is a casting core for casting molds, the casting core comprising an inner core and an outer core arranged around the inner core. The outer core contains or consists of ceramic particles bound with a binder. The inner core contains ceramic particles bound with a binder and additionally one or more placeholder elements. The placeholder element(s) is/are at least partially thermally decomposable. Also disclosed is a method for producing the casting core and use of the casting core.

17 Claims, No Drawings

CASTING CORE FOR CASTING MOULDS, AND METHOD FOR THE PRODUCTION THEREOF

PRIORITY APPLICATIONS

This application is a U.S. National Stage Filing under 35 U.S.C. § 371 from International Application No. PCT/EP2019/075170, filed on Sep. 19, 2019, and published as WO2020/058402 on Mar. 26, 2020, which claims the benefit of priority to German Application No. 10 2018 215 957.2, filed on Sep. 19, 2018; the benefit of priority of each of which is hereby claimed herein, and which applications and publication are hereby incorporated herein by reference in their entirety.

TECHNICAL FIELD

The present disclosure relates to a casting core for casting molds.

BACKGROUND

Casting cores, or cores, are used when casting components in molds so that, while whilst the mold is being filled, any cavities to be provided in the subsequent component are kept clear of casting material.

DETAILED DESCRIPTION

Casting cores must have the necessary strength and must remain dimensionally stable during the casting process. Impregnation of the casting cores by the melt during the casting process at elevated pressure must be prevented. In order to achieve a good cast surface, additional requirements are placed on the core material. Here, minimal wetting between the melt and casting core and a smooth, chemically suitable surface are advantageous. In particular in the case of casting cores for the production of a complex inner mould, good decomposability is required in order to ensure removal of the core material out of the component after the casting.

For the production of casting cores, normally fire-resistant fillers (e.g. quartz sand, zirconium sand, aluminosilicates, but also inorganic hollow balls) with an organic (e.g. synthetic resins, protein binders) or inorganic binder (silicate binders, phosphate binders) are brought into the required shape, the hardening of which can be effected respectively by cold or hot methods. The shaping can take place by pressing, core firing or casting. The surface of the cores can be improved by applying sizing. The thermal decomposition of the organic binders during the casting process weakens the core structure and enables removal of the core material out of the cast part, however is also associated with the emission of environmentally toxic gases. Furthermore, these gases can lead to errors in the cast part. In the case of thick-wall components, the result can be that the introduced heat is not sufficient to decompose the binder in the core interior sufficiently for easy mould removal. The gas evolution can also be problematic for the casting process. The core sands which are used generally cannot be reused and must be disposed of as special waste. In the case of inorganic binder systems, in addition to sufficient core strength, also good removability from the mould must be provided. The heat introduction must loosen the structure and sintering must be excluded. Furthermore, the conventional cores, as described above, are suitable only for sand, chill- and low-pressure casting. They cannot be used for pressure casting.

On this basis, it was the object of the present invention to indicate a casting core which, on the one hand, remains dimensionally stable during the casting process and, on the other hand, can be removed easily from the cast component after the casting process.

According to the invention, a casting core for casting moulds is indicated, which core comprises a core heart and a core sheath disposed around the core heart. The core sheath comprises ceramic particles bonded by a binder or consists hereof. The core heart comprises ceramic particles bonded by a binder and also in addition a placeholder element or a plurality of placeholder elements. The placeholder element is or the placeholder elements are at least partially thermally decomposable.

The casting core according to the invention advantageously comprises a plurality of parts, namely an inner part, the core heart and an outer part, the core sheath. As a result of this core construction with a core sheath which is in contact with the melt, and a core heart, the casting core according to the invention is adapted optimally to the different requirements during and after a casting process. Because of the presence of the thermally decomposable placeholder elements in the core heart, the core heart can be destabilised by thermal stress, as a result of which the removal of the casting core from the cast part is simplified. Because of the heat introduction during the casting process which is e.g. at a temperature in the range of 300° C. to 1,500° C., the placeholder element or placeholder elements are thermally decomposed, i.e. for example combusted or massively shrunk in volume, as a result of which the material cohesion of the core heart is weakened and hence removal of the casting core is simplified. In other words, at the places at which previously the placeholder element or the placeholder elements were situated, gaps or cavities are produced, for which reason the core heart becomes porous or unstable. This instability then simplifies removal of the casting core. Since the thermally decomposable placeholder element(s) are disposed however only in the core heart and not in the core sheath, the core sheath or the casting core has a dense and mechanically strong surface which is suitable for contact with the melt in the casting process, for which reason the casting core remains dimensionally stable during the casting process.

Because of the core construction from a core sheath which is in contact with the melt and a core heart, the functionality of the material composition can be adapted in the different core regions to the opposing requirements. Thus, in the sheath, fillers or ceramic particles can be used which have a low interaction with the melt. In addition, in the core sheath, also a lower porosity and higher mechanical strength can be provided. The thermal properties can be chosen by the fillers used in the core sheath such that, according to the casting temperature and introduced quantity of heat, a temporally offset destabilisation of the core heart is effected. Because of this decoupling, high process reliability and good casting quality can be achieved. The thermally decomposable placeholder element(s) reduce the quantity of inorganic fillers or ceramic particles which must be disposed of if necessary and reduce the weight of the cores.

A preferred embodiment of the casting core according to the invention is distinguished by the ceramic particles of the core sheath and/or the ceramic particles of the core heart being selected from the group consisting of quartz sand particles, zirconium sand particles, aluminosilicate particles, mullite particles, inorganic hollow balls, aluminium oxide particles and mixtures hereof.

By means of the choice of fillers or ceramic particles used in the core sheath, the thermal properties can be influenced such that, according to the casting temperature and introduced quantity of heat, a temporally offset destabilisation of the core heart is effected. Hence in this way, the speed of the temperature rise in the core heart and hence the beginning of the breakdown of the material cohesion in the core heart can be adjusted via the thermal properties of the core sheath. Hence, an increased pressure resistance of the casting core is ensured during the filling of the mould and, after sufficient introduction of heat into the cores, destabilisation of the core is produced.

According to a further preferred embodiment of the casting core according to the invention, the ceramic particles of the core sheath and/or the ceramic particles of the core heart have an average particle diameter of 0.5 μm to 500 μm. The average particle diameter can be determined, e.g. by means of laser diffraction.

Furthermore, it is preferred that the binder of the core sheath and/or the binder of the core heart is selected from the group consisting of

- inorganic binders, preferably silicate binders, e.g. silica sols and waterglass, phosphate binders, plaster, cement,
- organic binders, preferably plastic material resins, protein binders, and
- mixtures hereof.

A further preferred embodiment of the casting core according to the invention is characterised in that the placeholder element(s) is/are at least partially thermally decomposable from (or at) a temperature in the range of 300° C. to 1,500° C., preferably from (or at) a temperature in the range of 400° C. to 1,400° C., preferably from (or at) a temperature in the range of 500° C. to 1,300° C.

The feature that the placeholder element(s) is/are at least partially thermally decomposable from a temperature in a range of 300° C. to 1,500° C. should thereby be understood such that the placeholder element(s) decomposes or partially decomposes from any temperature in the range of 300° C. to 1,500° C. For example, the placeholder element or the placeholder elements can decompose from a temperature of 800° C., which means that the placeholder element or the placeholder elements is/are thermally decomposable at a temperature ≥800° C. Thermal decomposition can be e.g. combustion, e.g. partial combustion or residue-free combustion, of the placeholder element or of the placeholder elements.

Preferably, the placeholder element(s) is/are thermally decomposable or completely thermally decomposable from (or at) a temperature in the range of 300° C. to 1,500° C.

It is also possible that the placeholder element(s) is/are thermally decomposable over the entire temperature range of 300° C. to 1,500° C.

Furthermore, it is preferred that the placeholder element (s) is/are combustible, preferably combustible without residue.

A further preferred embodiment of the casting core according to the invention is distinguished by the placeholder element(s) being selected from the group consisting of wood foam elements, polymer foam elements, polystyrene balls, polymer granulates and mixtures hereof.

According to a further preferred embodiment, the core heart consists of the ceramic particles bonded by the binder and also the placeholder element (elements).

A further preferred embodiment is characterised in that the core sheath and the core heart have pores with an average pore size of 1 μm to 50 μm, the core sheath having a lower porosity than the core heart. The average pore size and/or the porosity can be determined, for example, by mercury porosimetry.

Furthermore, it is preferred that the core sheath has a thickness of 3 mm to 15 mm, preferably of 3 mm to 10 mm, particularly preferably of 3 mm to 7 mm. Via the thickness of the core sheath, the speed of the temperature rise in the core heart and hence the beginning of the breakdown of the material cohesion in the core heart can be adjusted. Hence an increased pressure resistance of the core during the filling of the mould is ensured and, after sufficient introduction of heat into the cores, destabilisation of the core is produced.

According to a further preferred embodiment, the core heart has a diameter of 5 mm to 100 mm, preferably of 10 mm to 100 mm, particularly preferably of 15 mm to 100 mm.

The present invention relates, in addition, to a method for the production of a casting core according to the invention, in which a) a mixture of a first aqueous, ceramic suspension, which comprises ceramic particles, a binder and water, and one or more place holder element(s)
   - is produced and subsequently is poured into a first casting mould which has the negative contour of a core heart of the casting core to be produced, or
   - is produced in a first casting mould which has the negative contour of the core heart of the casting core to be produced,
   - the place holder element(s) being at least partially thermally decomposable (preferably from or at a temperature in the range of 300° C. to 1,500° C.),
b) the mixture situated in the first casting mould is solidified to form the core heart of the casting core,
c) the core heart of the casting core is removed from the first casting mould and subsequently dried,
d) the dried core heart of the casting core is inserted in a second casting mould which has the negative contour of the casting core to be produced, and subsequently a second aqueous ceramic suspension, which comprises ceramic particles, a binder and water, is poured into this second casting mould,
e) the second ceramic suspension situated in the second casting mould is solidified to form a core sheath of the casting core,
f) the casting core comprising the core heart and the core sheath is removed from the second casting mould and subsequently dried.

For example inorganic binders based on plaster, cement, phosphate or silica can be used. Binders based on water glass can be gassed with carbon dioxide after the shaping. The water glass reacts with the formation of colloidal silicic acid and sodium carbonate and hence solidifies the suspension to form the corresponding part of the casting core. In the case of suspensions with water glass or colloidal silica sol as binder, also by displacing the pH value into the neutral range (for example by addition of an acid) or drying, solidification can be obtained. After shaping, excess water and bonded water which can be split off at the required casting temperature of the metal melt and could thereby impair the casting quality, must be removed. This takes place by drying. If the required drying temperature is higher than the temperature resistance of the place holder elements used, a partially thermal decomposition of the place holder elements begins already during drying and the porosity or the instability in the core heart is increased.

The drying in steps c) and f) is effected preferably at a temperature of 50° C. to 300° C., particularly preferably of 90° C. to 200° C. and/or over a duration of 0.1 to 10 hours, preferably of 0.5 to 5 hours, particularly preferably of 1 to 3 hours. The drying can be effected over a plurality of steps, for example a low temperature being chosen in the first drying step and a higher temperature in the second drying step.

In metal casting, it is standard and hence readily common knowledge to the person skilled in the art that cores are positioned and held in the casting mould via core marks and core mounts. This can also take place in the present invention or in the method according to the invention. Preferably, between step c) and step d), the dried core heart is hence provided with core marks (for positioning the core heart in the second casting mould). The core marks then enable exact positioning of the core heart within this second casting mould during insertion of the dried core heart of the casting core into the second casting mould so that the core heart has correspondingly the desired position later in the completed core.

A preferred variant of the method according to the invention is distinguished by, in step a), a mixture of a first aqueous, ceramic suspension, which comprises ceramic particles, a binder and water, and a plurality of place holder elements, preferably polystyrene balls, being produced and the mixture being poured subsequently into a first casting mould which has the negative contour of a core heart of the casting core to be produced.

A further preferred variant of the method according to the invention is characterised in that, in step a), a mixture of a first aqueous, ceramic suspension, which comprises ceramic particles, a binder and water, and a place holder element, preferably a wood foam element or a polymer foam element, is produced in a first casting mould which has the negative contour of the core heart of the casting core to be produced, firstly the placeholder element being cut to the shape of the core heart and being placed in the first casting mould and subsequently the place holder element being infiltrated and/or poured around with the first aqueous, ceramic suspension.

In addition, the present invention relates to the use of a casting core according to the invention in a method for casting one or more components.

The present invention is intended to be explained in more detail with reference to the subsequent examples without restricting said invention to the specific embodiments and parameters shown here.

Embodiment 1

A core mass based on a phosphate binder is produced as follows: 60% phosphate binder "Wirovest"® (BEGO) and 40% quartz dust are introduced in water until a flowable consistency is obtained. A reticulated foam material (Dryfeel™ based on polyether, pore size 15 ppi, Eurofoam™) is cut into the shape of the core heart, laid in a mold and infiltrated and poured around with the produced core mass. After solidification begins, the component is removed from the mold. The core heart is dried (at 90° C. for removing excess water, subsequently at 180° C. for one hour) and laid into a dividable mould which images the geometry of the core. The core heart has the core material poured around it. After solidification and removal from the mold, the core is dried at a temperature of 180° C. for one hour.

Embodiment 2

50% by volume of polystyrene balls is stirred into a ceramic mass, consisting of 88.5% phosphate binder "Wirovest®" (BEGO) and 11.5% demineralized water, and poured into a mold for the core heart. The solidified component is removed from the mold and placed in the dividable core mold and has the following ceramic mass poured around: 40% mullite (Symulox® M72 KO, Nabaltec® average particle size between 7-15 μm) and 60% phosphate binder "Wirovest®" (BEGO) are agitated in water until a flowable mass is obtained. After solidification, the core is removed from the mold and dried at 100° C.

The invention claimed is:

1. A casting core provided in a state that is ready for casting of components in moulds, comprising:

a core heart, the core heart including multiple ceramic particles bonded by a binder and the core heart further including a placeholder element; and a core sheath disposed around the core heart;

wherein the core sheath includes multiple ceramic particles bonded into the core sheath by a binder separate from the multiple ceramic particles of the core heart, wherein the placeholder element is at least partially thermally decomposable during subsequent use of the casting core for casting an article using the casting core, wherein the core sheath has a thickness of between 3 mm and 15 mm, inclusive, and wherein the binder and the placeholder element remain present in the casting core for subsequent use during a casting process using the casting core, wherein the core sheath and the core heart have multiple pores, with an average pore size of 1 μm and 50 μm inclusive, and wherein the core sheath has a lower porosity than the core heart.

2. The casting core according to claim 1, wherein at least one of the ceramic particles of the core sheath or the ceramic particles of the core heart are at least one of: quartz sand particles, zirconium sand particles, aluminosilicate particles, mullite particles, inorganic hollow balls, aluminum oxide particles, or a mixture thereof.

3. The casting core according to claim 1, wherein at least one of the ceramic particles of the core sheath or the ceramic particles of the core heart have an average particle diameter of between 0.5 μm and 500 μm inclusive.

4. The casting core according to claim 1, wherein at least one of the binder of the core sheath or the binder of the core heart are at least one of: an inorganic binder or a phosphate binder, plaster, cement, an organic binder or a mixture thereof.

5. The casting core according to claim 4, wherein the inorganic binder is at least one of a silica sol, waterglass, or another silicate binder.

6. The casting core according to claim 4, wherein the organic binder is at least one of a plastic material resin or a protein binder.

7. The casting core according to claim 1, wherein the placeholder element is at least partially thermally decomposable from a temperature in a range between 300° C. and 1,500° C. inclusive.

8. The casting core according to claim 7, wherein the temperature range is between 400° C. and 1,400° C., inclusive.

9. The casting core according to claim 7, wherein the temperature range is between 500° C. and 1,300° C., inclusive.

10. The casting core according to claim 1, wherein the placeholder element is combustible.

11. The casting core according to claim 10, wherein the placeholder element is combustible without residue.

12. The casting core according to claim 1, wherein the placeholder element is selected from a wood foam element, a polymer foam element, polystyrene balls, polymer granulates, or mixtures thereof.

13. The casting core according to claim 1, wherein the core heart has a diameter of between 5 mm and 100 mm, inclusive.

14. The casting core according to claim 13, wherein the core heart has a diameter of between 15 mm and 100 mm, inclusive.

15. The casting core according to claim 1, wherein the thickness is between 3 mm and 7 mm, inclusive.

16. A casting core provided in a state that is ready for casting of components in moulds, comprising:

a core heart, the core heart including multiple ceramic particles bonded by a binder, and the core heart further including a placeholder element; and a core sheath;

wherein the core sheath includes multiple ceramic particles bonded into the core sheath by a binder separate from the multiple ceramic particles of the core heart, wherein at least one of the ceramic particles of the core sheath or the ceramic particles of the core heart are at least one of: quartz sand particles, zirconium sand particles, aluminosilicate particles, mullite particles, inorganic hollow balls, or a mixture thereof, wherein at least one of the binder of the sheath or the binder of the core heart is at least one of an inorganic binder or an organic binder, wherein the placeholder element is at least partially thermally decomposable during subsequent use of the casting core for casting an article using the casting core, wherein the placeholder element is combustible without residue, and the placeholder element is at least one of: a wood foam element, a polymer foam element, polystyrene balls, polymer granulates, or a mixture thereof, wherein the core sheath has a thickness of between 3 mm and 15 mm, inclusive, and wherein the binder and the placeholder element remain present in the casting core for subsequent use during a casting process using the casting core, wherein the core sheath and the core heart have multiple pores, with an average pore size of 1 μm and 50 μm, inclusive, and wherein the core sheath has a lower porosity than the core heart.

17. The casting core of claim 16, wherein:

the placeholder element is at least partially thermally decomposable from a temperature in a range between 300° C. and 1500° C., inclusive; and the core heart has a diameter of between 5 mm and 100 mm, inclusive.

* * * * *